US011591698B2

(12) United States Patent
Neighbor et al.

(10) Patent No.: US 11,591,698 B2
(45) Date of Patent: Feb. 28, 2023

(54) REACTIVE CORROSION PROTECTION SYSTEMS AND METHODS FOR MAKING AND USING THE SAME

(71) Applicant: Osmose Utilities Services, Inc., Peachtree City, GA (US)

(72) Inventors: Kristopher Mark Neighbor, Peachtree City, GA (US); Kevin Niles, Peachtree City, GA (US)

(73) Assignee: Osmose Utilities Services, Inc., Peachtree City, GA (US)

( * ) Notice: Subject to any disclaimer, the term of this patent is extended or adjusted under 35 U.S.C. 154(b) by 69 days.

(21) Appl. No.: 16/826,055

(22) Filed: Mar. 20, 2020

(65) Prior Publication Data

US 2020/0299846 A1 Sep. 24, 2020

Related U.S. Application Data

(60) Provisional application No. 62/822,281, filed on Mar. 22, 2019.

(51) Int. Cl.
*C23F 13/14* (2006.01)

(52) U.S. Cl.
CPC ..... *C23F 13/14* (2013.01)

(58) Field of Classification Search
CPC ..... C23F 13/14; C23F 13/06; C23F 13/08; C23F 13/10; C23F 13/12; C23F 13/16
See application file for complete search history.

(56) References Cited

U.S. PATENT DOCUMENTS

| | | | | |
|---|---|---|---|---|
| 3,639,174 | A | 2/1972 | Kegelman | |
| 5,985,957 | A * | 11/1999 | Sakakibara | C09D 5/106 106/14.05 |
| 7,291,186 | B2 | 11/2007 | Zhang | |
| 7,931,981 | B2 | 4/2011 | Boone et al. | |
| 9,534,120 | B2 | 1/2017 | Matzdorf et al. | |
| 9,758,426 | B2 | 9/2017 | Kabagambe et al. | |
| 2009/0252986 | A1 * | 10/2009 | Owen | C23F 13/06 428/623 |
| 2014/0202879 | A1 | 7/2014 | Bennett | |

(Continued)

FOREIGN PATENT DOCUMENTS

| | | | | |
|---|---|---|---|---|
| CN | 101760747 | A | 6/2010 | |
| JP | 2012021211 | A * | 2/2012 | C23F 13/06 |

OTHER PUBLICATIONS

"Fleece." Merriam-Webster.com Dictionary, Merriam-Webster, https://www.merriam-webster.com/dictionary/fleece. Accessed Mar. 14, 2022. (Year: 2022).*

(Continued)

*Primary Examiner* — Alexander W Keeling
*Assistant Examiner* — Mofoluwaso S Jebutu
(74) *Attorney, Agent, or Firm* — Troutman Pepper Hamilton Sanders, LLP; James E. Schutz; Korbin Blunck

(57) ABSTRACT

This disclosed technology includes a cathodic protection system for protection of metal components. The cathodic protection system can include a non-solid anodic composition, such as an anodic paste. The non-solid anodic composition can include zinc and/or magnesium. The cathodic protection system can include a barrier protection system that can include one or more layers. The barrier protection system can include an outer moisture barrier.

20 Claims, 3 Drawing Sheets

(56) References Cited

U.S. PATENT DOCUMENTS

| | | | | |
|---|---|---|---|---|
| 2016/0195216 | A1* | 7/2016 | Bondil | C23F 13/14 428/36.5 |
| 2017/0121828 | A1 | 5/2017 | Simpson et al. | |
| 2018/0180215 | A1* | 6/2018 | Ghosh | B32B 1/00 |
| 2018/0266617 | A1* | 9/2018 | Yoon | C23F 13/18 |
| 2019/0022797 | A1* | 1/2019 | Hoyer | B29C 45/14311 |
| 2021/0040624 | A1* | 2/2021 | Abbott | B32B 15/09 |

OTHER PUBLICATIONS

International Search Report & Written Opinion from corresponding International Application No. PCT/US2020/024037 dated Jun. 16, 2020.

* cited by examiner

REACTIVE CORROSION PROTECTION SYSTEMS AND METHODS FOR MAKING AND USING THE SAME

CROSS-REFERENCE TO RELATED APPLICATION

This application claims the benefit of U.S. Provisional Application No. 62/822,281, filed 22 Mar. 2019, the entire contents and substance of which is hereby incorporated by reference.

FIELD OF DISCLOSURE

This disclosure relates to corrosion-preventing systems for the preventive and/or protective treatment of metals in service, such as buried or partially buried metal structures.

BACKGROUND

Metal components exposed in an outdoor environment can be susceptible to corrosion and other degradations. For example, metal structures, such as electrical grid transmission structures (e.g., lattice towers, steel poles), cellular network towers, radio masts, and bridges, can have one or more portions of the metal structure that is buried or otherwise exposed to conditions conducive to deterioration such as corrosion. These concerns can be relevant in situations in which metal components are buried in the ground. For example, steel may also be susceptible to damage by microorganisms, and this damage may be referred to as microbial induced corrosion (MIC). Over time, however, the metal components can corrode or otherwise degrade, which can result in the metal components weakening in strength and reducing the useful life of the metal components and/or the systems incorporating the metal components. Accordingly, there is a need to prevent corrosion and other degradations to metal components, which can extend the useful life of the metal components and/or systems incorporating the metal components.

SUMMARY

The above-discussed problems, and other concerns, can be addressed by the technology disclosed herein. Certain embodiments of this technology include a cathodic protection system. The cathodic protection system can include a substrate layer. The substrate layer can include a non-solid anodic composition, which can be in paste or putty form. The anodic composition can include zinc and/or magnesium. The anodic composition can include a high concentration percentage (e.g., greater than or equal to about 65% by weight (about 65 wt %), by weight of the anodic composition; greater than or equal to about 90% by weight (about 90 wt %), by weight of the anodic composition) of zinc and/or magnesium. That is, the specific concentration of zinc and the specific concentration of magnesium can be any value such that the combined concentration of zinc and/or magnesium with respect to the entire anodic composition is any of the concentration percentages provided herein. The anodic composition can contain aluminum. The anodic composition can include a high concentration percentage (e.g., a concentration greater than or equal to about 65% by weight (about 65 wt %), by weight of the anodic composition; a concentration greater than or equal to about 90 wt %, by weight of the anodic composition) of aluminum. The anodic composition can optionally include copper carbonate or solubilized copper, which can be useful for antibacterial purposes. The anodic composition can optionally include an electrochemically-activated pigment, which can provide a visual indication of the voltage differential current between the buried steel member and the surrounding environment, such as a soil environment surrounding a buried metal component to which an amount of the anodic composition has been applied.

The cathodic protection system can include a barrier protection system comprising one or more layers. The cathodic protection system can be configured to at least partially surround the metal component and/or an amount of the anodic composition applied to the metal component. The barrier layer can be flexible, such as a fabric. The barrier layer can be semi-rigid. The barrier layer can include bonded and/or unbonded zinc wool or similar material. The barrier layer can include a bonded and/or unbonded zinc wool or a similar substrate. The barrier layer can include bonded zinc wool on a portion of the barrier layer, such as on an interior-facing side (e.g., facing the metal component and/or anodic composition) of the barrier layer. The barrier layer can be impregnated with an amount of the anodic composition. The barrier layer can include an interior portion (e.g., facing the metal component and/or anodic composition) that is impregnated with an amount of the anodic composition. The barrier layer can have hydrophobic properties, which can prevent water from passing through the barrier layer to the anodic composition and/or the metal component. The barrier layer can have ultraviolet (UV) protectant properties, which can protect the barrier layer from degradation caused by UV radiation. The barrier layer can optionally include an electrochemically-activated pigment, which can provide a visual indication of the voltage differential current between the buried steel member and the surrounding environment, such as a soil environment surrounding a buried metal component to which a portion of the barrier layer has been applied.

BRIEF DESCRIPTION OF THE FIGURES

Reference will now be made to the accompanying figures, which are not necessarily drawn to scale, and wherein.

DETAILED DESCRIPTION

Figure 1:
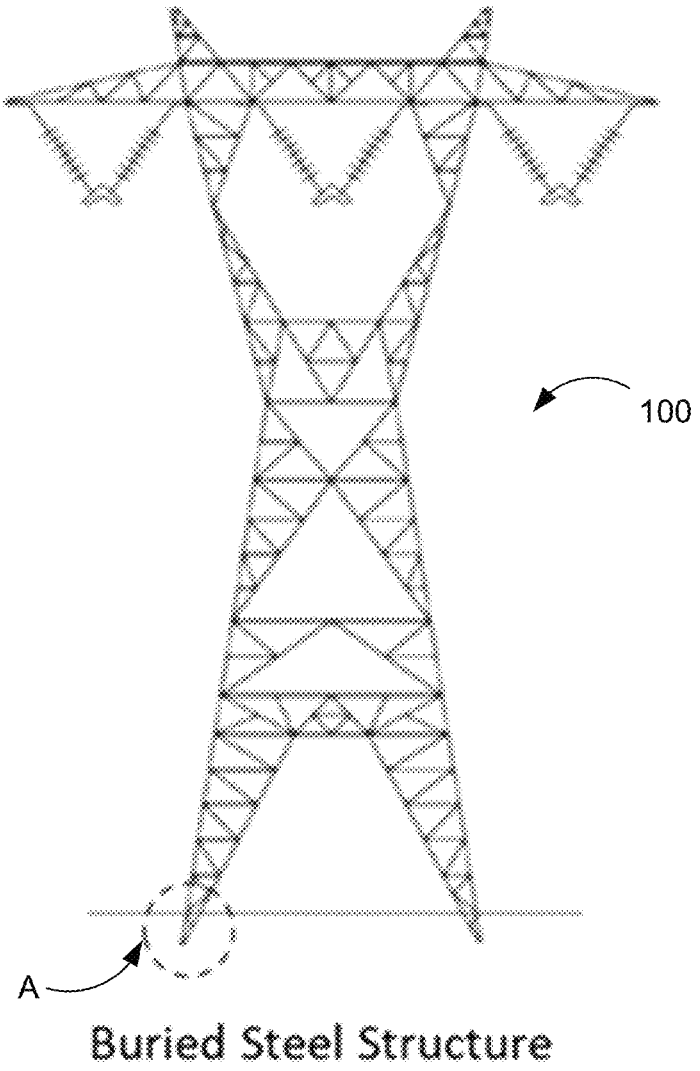
FIG. 1 is a diagram of an example metal structure, according to the present disclosure.

Unless stated otherwise, such as in the examples, all amounts and numbers used in this specification are intended to be interpreted as modified by the term "approximately" or the term "about." Likewise, all elements or compounds identified in this specification, unless stated otherwise, are intended to be non-limiting and representative of other elements or compounds generally considered by those skilled in the art as being within the same family of elements or compounds.

As used herein, the term "micronized" means a particle size in the range of approximately 0.001 to approximately 25 microns. As used herein, the term "particle size" means the largest axis of the particle, and in the case of a generally spherical particle, the largest axis is the diameter. Furthermore, it should be understood that "micronized" does not refer only to particles that have been produced by the finely dividing, such as by mechanical grinding, of materials that are in bulk or other form. Micronized particles can also be formed by other mechanical, chemical, or physical methods, such as, for example, formation in solution, with or without a seeding agent, grinding or impinging jet.

As used herein, "copper-solubilizing agents" mean any agent that promotes the solubility of copper metal or a copper compound in an aqueous carrier. Copper-solubilizing agents include, but are not limited to ammonia and ammonium salts, amines, and alkanolmonoamines having between 2 to 18 carbon atoms, such as monoalkanolmonoamines, dialkanolmonoamines, and trialkanolmonoamines, and mixtures thereof. Examples include, but are not limited to, monoethanolamine, diethanolamine, triethanolamine, 3-aminopropanol, monoisopropanolamine, 4-aminobutanol, monomethylethanolamine, dimethylethanolamine, triethylethanolamine, monoethylethanolamine, N-methyldiethanolamine and mixtures thereof.

Disclosed herein are cathodic protection systems and methods for use thereof in treatment of in-service metal components (e.g., electrical grid transmission towers, poles, cellular network towers, radio masts, bridges) for the preventive and/or protective treatment of those metal components. The cathodic protection systems can include an anodic composition. The cathodic protection systems can include an anodic composition and a barrier layer, as disclosed more fully herein. The cathodic protection systems can provide a single system including both the protection characteristics of a barrier system and the protection characteristics of an anode. The cathodic protection systems can be applied manually (e.g., by hand, with basic hand tools). The cathodic protection systems may be configured for installation and/or application without requiring additional curing. As another example, the cathodic protection systems do not require multi-layered application that can be required by many existing barrier protection systems. As another example, the cathodic protection systems do not require additional excavation (e.g., other than excavating the metal component itself) for, and installation of, remote anodes. The cathodic protection systems disclosed herein can be used as a standalone system or can be used in conjunction with traditional cathodic protection systems using either galvanic or impressed current cathodic protection, thus enhancing the protective capabilities of such cathodic protection system.

The compositions disclosed herein can optionally contain no more than 36, 30, 20, 10, 5, 2 or 1 grams volatile organic compounds (VOCs) per liter of the composition. VOCs may not be detectable by gas chromatography/mass spectrometry (GC/MS). VOCs may not be detectable by gas chromatography according to EPA Method 8620c, Volatile Organic Compounds by Gas Chromatography Mass Spectrometry (GC/MS) (June 2018).

The anodic composition can be formulated into a non-solid formulation or substrate. The anodic composition can be in a paste or putty form. The anodic composition can have a sufficiently high viscosity and/or have an adhesive nature such that, upon application of the anodic composition to a metal component, the anodic composition can substantially retain its position on the metal component (e.g., the anodic composition will not drip, "run," or otherwise flow off of, or out of a desired position on, the metal component). The anodic composition can have a sufficiently negative electrochemical potential with respect to the metal component. This can provide cathodic protection to the metal component. For example, from a galvanic series, the native potential of magnesium may be approximately −1.700 mV, the native potential of zinc may be approximately −1.100 mV, and the native potential of aluminum may be approximately −1.000 mV with reference to a copper sulfate ($CuSO_4$) reference electrode. New steel may have a native potential of approximately −0.850 mV, and galvanized steel may have a native potential of approximately −0.850 mV to approximately −1.100 mV. The reactive values of these materials may be the same or similar when incorporated into the anodic composition.

The anodic composition can contain zinc and/or magnesium. Zinc and/or magnesium can function as "active" ingredients by providing a general active anodic composition capable of supplementing existing galvanization of metal components and/or providing corrosion protection to painted or bare metal components. The anodic composition can include micronized zinc and/or micronized magnesium. The anodic composition can include a concentration percentage of zinc and/or magnesium that is greater than or equal to about 65 wt % (e.g., greater than or equal to about 70 wt %, greater than or equal to about 75 wt %, a greater than or equal to about bout 80 wt %, greater than or equal to about 85 wt %). The anodic composition can include a high concentration percentage (e.g., greater than or equal to about 90 wt %, about 91 wt %, about 92 wt %, about 93 wt %, about 94 wt %, about 95 wt %, about 96 wt %, about 97 wt %, about 98 wt %, or about 99 wt %, by weight of the anodic composition) of zinc and/or magnesium. For example, the anodic composition can include a concentration of zinc greater than or equal to about 90 wt %. As another example, the anodic composition can include a concentration of magnesium greater than or equal to about 90 wt %, by weight of the anodic composition. As yet another example, the anodic composition can include a concentration of zinc greater than or equal to about 45 wt %, by weight of the anodic composition, and a concentration of magnesium greater than or equal to about 45 wt %, by weight of the anodic composition, such that the combined concentration of zinc and magnesium is greater than or equal to about 90 wt %, by weight of the anodic composition. The anodic composition can include aluminum, which can be useful as an active ingredient and/or as a filler ingredient. While certain materials are disclosed herein as being useful "active" ingredients, the disclosed technology is not so limited. Instead, the disclosed technology includes other known materials having anodic properties, as well as any materials having properties useful for incorporation as filler materials.

The anodic composition can optionally include an antibacterial agent. While such agent can provide antibacterial properties, care should be taken to avoid otherwise unnecessary corrosion of the treated metal components. The anodic composition can include copper. The anodic composition can include copper carbonate or solubilized copper. The copper carbonate and/or solubilized copper can be micronized. For example, the anodic composition can include a fine copper particulate, such that is found in dispersions through a milling process or the like. The anodic composition can include a relatively small concentration of copper. For example, the anodic composition can include copper in the concentration range of about 0.001 wt % to about 10 wt % (e.g. about 0.1 wt % to about 10 wt %, about 0.1 wt % to about 0.4 wt %, about 0.4 wt % to about 0.6 wt %, about 0.6 wt % to about 0.8 wt %, about 0.8 wt % to about 1 wt %, about 1 wt % to about 2 wt %, about 2 wt % to about 4 wt %, about 4 wt % to about 6 wt %, about 6 wt % to about 8 wt %, about 8 wt % to about 10 wt %, about 1 wt % to about 5 wt %, about 5 wt % to about 10 wt %), by weight of the anodic composition. As will be appreciated, copper above a predetermined threshold (e.g., in relatively large amounts or concentrations) may negatively affect steel (e.g., because steel is anodic to copper), while certain amounts of copper below the predetermined threshold (e.g., relatively small amounts or concentrations) may assist with conductivity of the anodic composition and/or may decrease, mitigate, or eliminate MIC. Further, certain amounts of copper below the predetermined threshold (e.g., relatively small amounts or concentrations) may provide a small or negligible corrosive effect on a sufficiently large area of steel.

The anodic composition can optionally include an electrochemically-activated pigment. The electrochemically-activated pigment can provide a visual indication of the voltage differential current between the buried steel member and the surrounding environment, such as a soil environment surrounding a buried metal component to which an amount of the anodic composition has been applied. This can be useful for determining, before burying a metal component, whether a sufficient amount of anodic composition has been applied and/or whether the anodic composition has been properly applied.

The anodic composition can include petroleum (e.g. petrolatum) and/or an aqueous and/or petroleum thickening agent. For example, the anodic composition can include aqueous organic polymer, aqueous emulsion, clay minerals, phosphate and the like are the aqueous type of thickening agents. Aqueous organic polymers can include cellulose derivatives including cellulose esters and ethers. Cellulose esters can include cellulose nitrate, sulfate, cellulose phosphate, cellulose nitrite, cellulose xanthate, cellulose acetate, cellulose formate, and cellulose esters with other organic acids. Cellulose ethers can include methylcellulose, ethylcellulose, propylcellulose, benzylcellulose, carboxymethylcellulose, hydroxyethylcellulose, hydroxypropylcellulose, hydroxybutylcellulose, cyanoethylcellulose, and carboxyethylcellulose. Cellulose derivatives can include cellulose ethers such as hydroxyethylcellulose, hydroxypropylcellulose, carboxymethylcellulose and carboxyethylcellulose. The concentration of the cellulose derivative in the anodic composition can be from about 0.01 wt % to about 50 wt % (e.g., about 0.1 wt % to about 20 wt %, about 0.5 wt % to about 10 wt %, about 5 wt % to about 30 wt %, about 10 wt % to about 40%, about 15 wt % to about 50 wt %), by weight of the anodic composition.

The anodic composition can include about 0.5 wt % to about 30 wt % (e.g., about 0.5 wt % to about 10 wt %, about 0.5 wt % to about 20 wt %, about 5 wt % to about 30 wt %, about 10 wt % to about 25%, about 15 wt % to about 30 wt %), by weight of the anodic composition. of an inorganic clay thickening agent or a mixture of such thickening agents. The inorganic clay thickening agents can include a fibrous structure type such as attapulgite clay and sepiolite clay, a non-crystal structure type such as allophone, and mixed layer structure type such as montmorillonite and kaolinte and the above layer structure types. Examples of inorganic clay minerals include, but are not limited to, attapulgite, dickite, saponite, montmorillonite, nacrite, kaolinite, anorthite, halloysite, metahalloysite, chrysotile, lizardite, serpentine, antigorite, beidellite, hectonite, smecnite, bentonite, nacrite and sepiolite, montmorillonite, sauconite, stevensite, nontronite, saponite, hectorite, vermiculite, sepiolite, nacrite, illite, sericite, glauconite-montmorillonite, roselite-montmorillonite, Bentone 38 (hectorite) and Bentone 34 (bentonite), chlorite-vermiculite, illite-montmorillonite, halloysite-montmorillonite, kaolinitemontmorillonite. The clay minerals can include exchangeable cations including, but not limited to, aluminum ions, protons, sodium ions, potassium ions, calcium ions, magnesium ions, lithium ions, and the like.

Further, these inorganic clay minerals can display an improved thickening effect and thixotropic property in comparison with other aqueous thickening agents. The inorganic clay minerals can display little sagging and can be easily rinsed out by water in comparison with organic thickening agents.

It should be appreciated that thickening agents other than those described herein can be used.

The anodic composition can be applied to metal components via various processes. The anodic composition can be applied directly to a metal component. The anodic composition can be incorporated into a substrate or other suitable support material (such as zinc wool, as a non-limiting example) to form a ready-to-use wrap that can applied to in-service metal components and/or metal structures. For example, the anodic composition can be incorporated into polymer films, fabrics, fiberglass, polyester fiber, polypropylene, porous polymer compositions, and others that allow for the anodic reaction of the elements from within the bandage to the metal component and/or metal structure. The anodic composition can be applied to the support material by toweling, rolling, brushing and the like. The anodic composition can be directly applied to the support material or can require the use of a binder or resin such as for example acrylate resins or PVC with plasticizers. To improve the adhesion between the paste compositions and support material the combination can be air-dried or dried in an oven at elevated temperatures.

As discussed above, the cathodic protection system can also include a barrier protection system comprising one or more layers. Although it can include multiple layers, this element is referenced interchangeably herein as a barrier protection system or a barrier layer. The barrier layer can comprise a flexible substrate. For example, the barrier layer can include fabric or some other woven material, a flexible zinc sheet, a polymer, wax, or any other flexible substrate. The barrier layer can thus be configured to be applied over a metal component and/or an amount of the anodic composition. The barrier layer can include bonded and/or unbonded zinc wool or similar material. The bonded zinc wool can form the barrier layer. Alternately, the barrier layer can include the bonded zinc wool on an interior portion of the barrier layer (e.g., a side of the barrier layer configured to face the metal component and/or anodic composition). The barrier layer, or a portion of the barrier layer (e.g., an interior portion of the barrier layer, a portion of the barrier layer including bonded zinc wool) can be charged, filled, and/or impregnated with an amount of the anodic composition. For example, a portion of the barrier layer (such as a bonded zinc wool layer) may be fully impregnated with the anodic composition such that the anodic composition fills all voids of that portion of the barrier layer. Such impregnation of the barrier layer (or a portion thereof) with the anodic composition can help ensure uniform electrical conductivity throughout the cathodic protection system, while simultaneously helping to provide direct contact of the anodic composition's active ingredients to the metal component. As will be appreciated, in some environments, it may be useful for the anodic composition to have a lower resistance, but not necessarily high conductivity, as compared to the metal component.

The barrier layer, or a portion of the barrier layer, can be impregnated with the anodic composition under vacuum (a pressure significantly lower than atmospheric pressure) and/or submersion, such as by providing vacuum conditions in conjunction with injection into the zinc wool matrix.

The barrier layer can include a flexible zinc sheet having bonded zinc wool disposed on an interior face of the zinc sheet and a film (e.g., composed of a polymer) disposed on an exterior face of the zinc sheet. Such a system can provide an end-of-life indicator for the cathodic protection system, as the zinc sheet can become consumed over time and as different stresses are received through the barrier film. Accordingly, the barrier layer can include in the film a polymer that can change color based on received stress.

The barrier layer can include a semi-rigid material. This may, for example, enable the barrier layer to form a collar or annular about a metal component.

The barrier layer can include a hydrophobic material, which can be useful for preventing water from passing through the barrier layer to the anodic composition and/or the metal component. For example, an exterior-facing side of the barrier layer can include a hydrophobic material. As another example, the exterior-facing side of the barrier layer can be at least partially covered or coated with a hydrophobic material. As another example, petrolatum wax tape can be applied to cover the topmost edge of the barrier layer. As another example, a film, such as a polymer film, can be disposed on the exterior-facing side of the barrier layer. As yet another example, the hydrophobic material may comprise polytetrafluoroethylene (PTFE). Alternatively or in addition, the barrier layer can include an impermeable material.

The barrier layer can include a material having ultraviolet (UV) protectant properties (a "UV protectant material"), which can help protect the barrier layer from degradation caused by UV radiation. For example, an exterior-facing side of the barrier layer can include a UV protectant material. As another example, the exterior-facing side of the barrier layer can be at least partially covered or coated with a UV protectant material.

The barrier layer can optionally include an electrochemically-activated pigment, which can provide a visual indication of the voltage differential current between the buried steel member and the surrounding environment, such as a soil environment surrounding a buried metal component to which a portion of the barrier layer has been applied.

Figure 2:
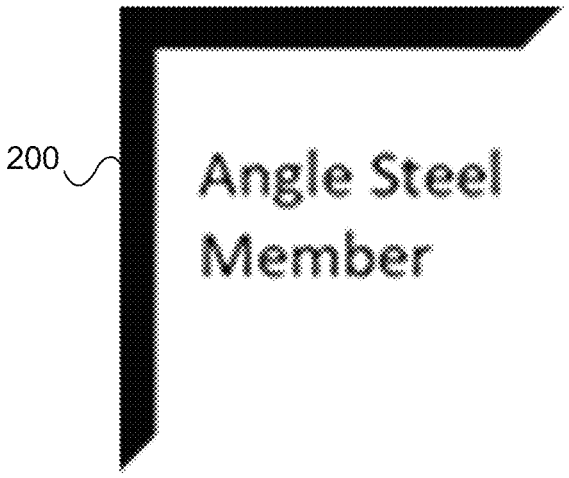
FIG. 2 is a magnified cross-sectional view of a metal component of the metal structure in FIG. 1.
Figure 3:
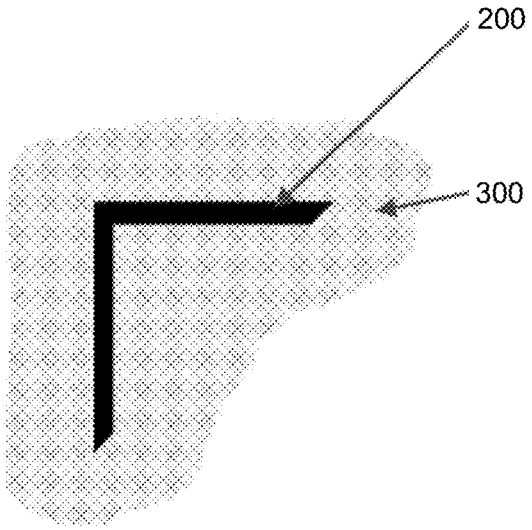
FIG. 3 is a cross-sectional diagram of an example anodic composition applied to a metal component, according to the present disclosure.
Figure 4:
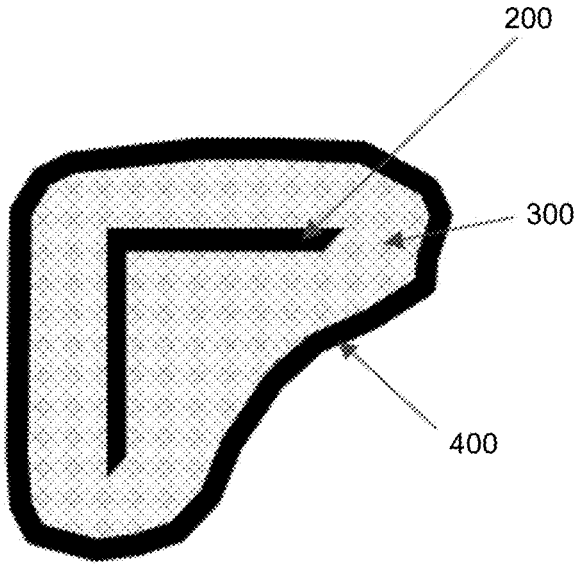
FIG. 4 is a cross-sectional diagram of an example barrier layer wrapped about an anodic composition applied to a metal component, according to the present disclosure.
Figure 5:
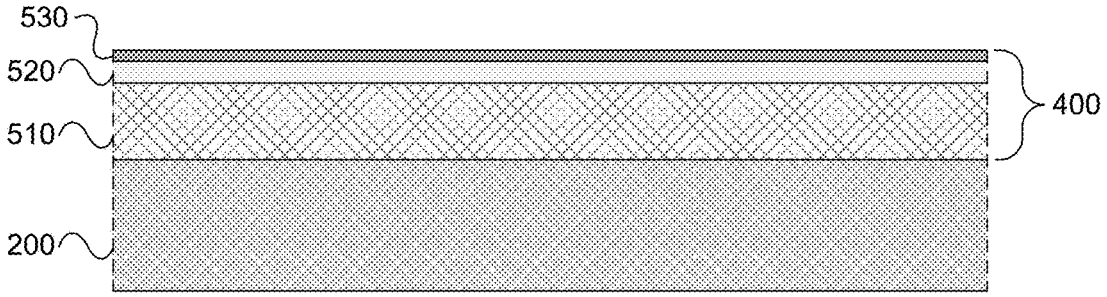
FIG. 5 is a cross-sectional diagram of an example barrier layer wrapped about an anodic composition applied to a metal component, according to the present disclosure.

To facilitate understanding of the disclosed technologies, the figures depict an example application of the cathodic protection system. FIG. 1 depicts a metal structure 100 having a buried metal component identified by callout A. As shown more clearly in FIG. 2, the buried metal component 200 can have an irregular cross-sectional shape or any other shape. Referring to FIG. 3, the anodic composition 300 can be applied to cover, coat, and/or surround the metal component 200. Due to its non-solid nature, the anodic composition 300 can be particularly suitable for application to irregularly shaped metal objects. For example, as shown in FIG. 4, the barrier layer 400 can be configured to wrap, cover, and/or surround at least a portion of the metal component 200 and/or the anodic composition 300. A more specific example is shown in FIG. 5. The metal component 200 can be covered and/or surrounded with the anodic composition 300 and/or a barrier layer 400 comprising the anodic composition 300. For example, the barrier layer 400 can include a zinc wool layer 510, and the zinc wool layer can be impregnated (e.g., fully impregnated) with the anodic composition 300. While referring to herein as a "zinc wool layer," it is contemplated that different material(s) can be used. The barrier layer 400 can include a zinc sheet 520. The zinc sheet 520 may be bonded to the zinc wool layer 510. The barrier layer 400 can include a barrier film 530, which may prevent moisture from entering from an external side of the barrier film 530 to an internal side of the barrier film 530 that is directed toward the metal component 200.

The cathodic protection system can include a barrier layer, as discussed. Alternately, the cathodic protection system may not include a barrier layer. For example, the cathodic protection system can include only the anodic composition. For example, the cathodic protection system can include the anodic composition and a separate sealant (e.g., a coating) applied to the anodic composition. As another example, a collar or cast can be positioned about the metal component, and an amount of the anodic composition can be inserted into the collar or cast such that the anodic composition is positioned substantially within the collar or case and between the metal component and the collar or cast. In such systems, it can useful for the anodic composition to be in a foam form. The anodic composition may be a non-solid foam or a solid foam, depending on the desired properties.

Figure 6:
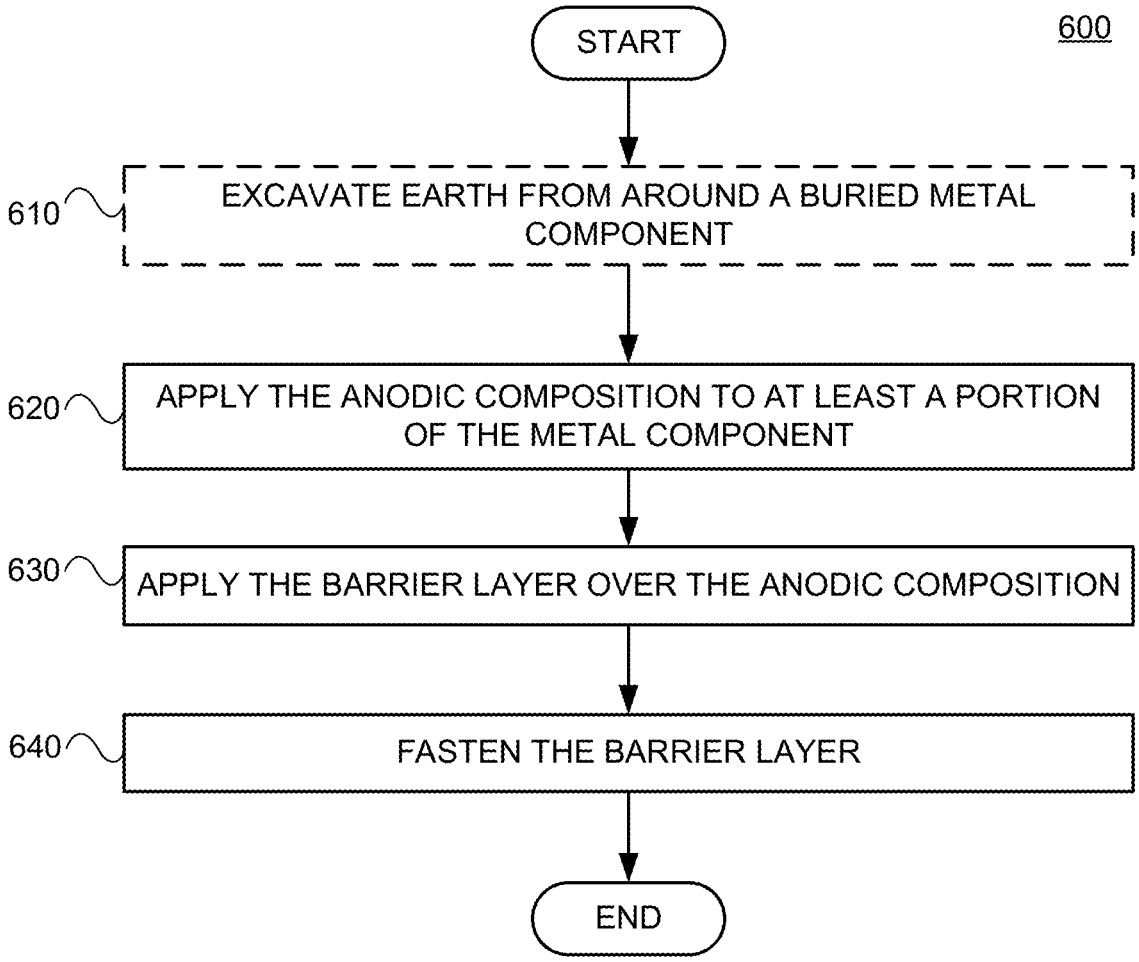
FIG. 6 is a flowchart depicting an example method for applying a cathodic protection system, according to the present disclosure.

The disclosed technology can include methods for applying a cathodic protection system to a metal component. For example, referring to FIG. 6, a method 600 for applying a cathodic protection system to a metal component can include excavating 610 earth from around a buried metal component. As will be appreciated, excavation can be accomplished by various machinery or by hand tools. The excavation can include excavating to a depth of about 24 inches below grade or any other depth as desired or required by application.

The method 600 can include preparing the surface and applying 620, such as by brush or some other method, the anodic composition to at least a portion of the metal component. Applying 620 can include applying the anodic composition from the bottom of the metal component (e.g., at or near the bottom of the excavation) to a predetermined height (e.g., about 6 inches, about 8 inches, about 12 inches) above grade. It may be necessary or helpful, to apply anodic composition to a different height, depending on the surrounding terrain. After applying the anodic composition, the method 600 can include applying 630 the barrier layer over the anodic composition. The barrier layer may be applied such that the barrier layer extends beyond the edges (e.g., the uppermost edge) of the anodic composition. The method 600 can include fastening 640 the barrier layer, such that the barrier layer is prevented from shifting along or about the metal component. The barrier layer can be fastened by wire ties, plastic (e.g., nylon) bands, or any other useful fastening or strapping method or device.

EXAMPLES

An example of the disclosed technology includes a reactive anodic corrosion protection system that includes a protective impermeable barrier. The impermeable barrier can include an external layer and an interior layer. The interior layer can include zinc wool; which can be filled and/or impregnated with a reactive anodic coating composition. The reactive anodic coating composition can include, for example, a petroleum-based, semi-solid paste body containing a high zinc load (e.g., greater than or equal to about 65% by weight (about 65 wt %), by weight of the anodic composition; greater than or equal to about 90% by weight (about 90 wt %), by weight of the anodic composition). The protective impermeable barrier can be applied to a portion of metal, such as a portion of a steel electric utility and/or similar structures. For example, the protective impermeable barrier can be applied below grade and a specific distance above grade portion of a steel electric utility and/or similar structures.

Another example of the disclosed technology includes a reactive anodic corrosion protection system that includes a protective UV-resistant barrier. The reactive anodic corrosion protection system can include or omit an interior layer of wool filled and/or impregnated with reactive anodic paste. The protective UV-resistant barrier can include an external partially-permeable (at least partially impermeable) layer. The reactive anodic corrosion protection system can include a reactive anodic coating composition that includes a petroleum-based, semi-solid paste body coating containing a high magnesium load (e.g., greater than or equal to about 65% by weight (about 65 wt %), by weight of the anodic composition; greater than or equal to about 90% by weight (about 90 wt %), by weight of the anodic composition). The protective impermeable barrier can be applied to a portion of metal, such as a portion of a steel electric utility and/or similar structures. For example, the protective impermeable barrier can be applied below grade and a specific distance above grade portion of a steel electric utility and/or similar structures.

While the disclosed technology has been described in connection with what is presently considered to be the most practical designs, it is to be understood that the disclosed technology is not to be limited to the disclosed designs, but on the contrary, is intended to cover various modifications and equivalent arrangements included within the scope of the appended claims. Although specific terms are employed herein, they are used in a generic and descriptive sense only and not for purposes of limitation.

What is claimed is:

1. A cathodic protection system comprising:

a non-solid anodic composition configured to directly contact a metal component and configured to be non-curably applied to the metal component in paste form; and a barrier protection system configured to hold at least some of the non-solid anodic composition in direct contact with the metal component, the barrier protection system comprising:

an innermost layer comprising an impregnable substrate impregnated with an amount of the non-solid anodic composition; and an outermost layer configured to prevent moisture from moving from an external side of the outermost layer to an internal side of the outermost layer.

2. The cathodic protection system of claim 1, wherein the non-solid anodic composition comprises zinc.

3. The cathodic protection system of claim 1, wherein the non-solid anodic composition comprises zinc having a concentration greater than or equal to about 65 wt %, by weight of the non-solid anodic composition.

4. The cathodic protection system of claim 1, wherein the non-solid anodic composition comprises zinc having a concentration greater than or equal to about 90 wt %, by weight of the non-solid anodic composition.

5. The cathodic protection system of claim 1, wherein the non-solid anodic composition comprises magnesium.

6. The cathodic protection system of claim 5, wherein the non-solid anodic composition comprises magnesium having a concentration greater than or equal to about 65 wt % by weight of the non-solid anodic composition.

7. The cathodic protection system of claim 5, wherein the non-solid anodic composition comprises magnesium having a concentration greater than or equal to about 90 wt % by weight of the non-solid anodic composition.

8. The cathodic protection system of claim 1, wherein the non-solid anodic composition comprises zinc and/or magnesium, the zinc and/or magnesium combining to have a concentration greater than or equal to about 65 wt % by weight of the non-solid anodic composition.

9. The cathodic protection system of claim 1, wherein the non-solid anodic composition comprises copper carbonate, solubilized copper, or a combination thereof.

10. The cathodic protection system of claim 1, wherein the non-solid anodic composition comprises an electrochemically-activated pigment configured to provide a visual indication of a voltage differential current.

11. The cathodic protection system of claim 1, wherein the barrier protection system is flexible.

12. The cathodic protection system of claim 1, wherein the impregnable substrate comprises bonded zinc wool or unbonded zinc wool.

13. The cathodic protection system of claim 1, wherein the outermost layer comprises a hydrophobic material.

14. The cathodic protection system of claim 1, wherein the outermost layer comprises an impermeable material.

15. The cathodic protection system of claim 1, wherein the outermost layer comprises an ultraviolet-protectant material.

16. The cathodic protection system of claim 1, wherein the barrier protection system comprises an electrochemically-activated indicator.

17. The cathodic protection system of claim 1, wherein the barrier protection system further comprises a zinc sheet located between the innermost layer and the outermost layer.

18. The cathodic protection system of claim 1, wherein the non-solid anodic composition comprises a petroleum thickening agent.

19. A reactive anodic coating system for protection of a metal structure, the reactive anodic coating system comprising:

an anodic paste configured to directly contact the metal structure and configured to be non-curably applied to the metal structure in paste form; and a multi-layer protection system configured to hold at least some of the anodic paste in direct contact with the metal structure, the multi-layer protection system comprising:

an innermost layer comprising an impregnable substrate impregnated with an amount of the anodic paste; and an outermost layer configured to prevent moisture from moving from an external side of the outermost layer to an internal side of the outermost layer.

20. The reactive anodic coating system of claim 19, wherein the anodic paste comprises zinc and/or magnesium, the zinc and/or magnesium combining to have a concentration greater than or equal to about 65 wt % by weight of the anodic paste.

* * * * *